United States Patent [19]

Kitani

[11] 4,409,794

[45] Oct. 18, 1983

[54] APPARATUS FOR ADJUSTING TRACE WATER CONTENT OF RICE-KOJI, WHEAT-KOJI, WHEAT BRAN-KOJI, STEAMED RICE, STEEPED RICE AND THE LIKE

[76] Inventor: Masanobu Kitani, 17-15, Nagasaki 2-chome, Toshima-ku, Tokyo, Japan

[21] Appl. No.: 290,699

[22] Filed: Aug. 6, 1981

[30] Foreign Application Priority Data

Jun. 11, 1980 [JP] Japan ..... 55-077637
Jun. 25, 1981 [JP] Japan ..... 56-097569

[51] Int. Cl.[3] ..... F25D 25/00

[52] U.S. Cl. ..... 62/98; 34/5; 34/15; 62/238.6; 426/444; 426/462; 426/463; 426/618

[58] Field of Search ..... 62/98, 238.6, 89; 426/443, 444, 618, 462, 463; 34/5, 15

[56] References Cited

U.S. PATENT DOCUMENTS 3,119,239 1/1964 Sylvan ..... 62/90
4,071,304 1/1978 Chauvin ..... 426/443

*Primary Examiner*—Ronald C. Capossela
*Attorney, Agent, or Firm*—Browdy and Neimark

[57] ABSTRACT

This invention is relating to an apparatus for adjusting the trace water content of rice koji, wheat koji, wheat bran-koji, steamed rice, steeped rice and the like characterized in that a condensor consists of two heat exchangers connected in series, and one of said heat exchangers is disposed in said air circulating route while the other is disposed outside said air circulating route. The apparatus of this invention can adjust the trace water content of rice koji, wheat koji, wheat bran-koji, steamed rice, steeped rice and the like.

4 Claims, 5 Drawing Figures

APPARATUS FOR ADJUSTING TRACE WATER CONTENT OF RICE-KOJI, WHEAT-KOJI, WHEAT BRAN-KOJI, STEAMED RICE, STEEPED RICE AND THE LIKE

DETAILED DESCRIPTION OF THE INVENTION

This invention relates to an apparatus for adjusting the trace water content of rice-koji, wheat-koji, wheat bran-koji, steamed rice, steeped rice and the like. More particularly, the present invention relates to an apparatus for adjusting the water content of rice particles to a water content which is most suited for the production of rice bran suitable for the brew of sake, miso, soy sauce, mirin, and so forth, especially for the production of highquality koji suitable for the brewing of sake.

The inventor of the present invention attached specific importance to the fact that a great difference in the quality of koji occurs in accordance with the difference in the water contents of steamed rice particles, and developed an apparatus in which the changes in the air temperature are small and which is capable of adjusting the trace water content by concurrently disposing a cooler and a heater by use of a heat pump using one set of freezing cycle and connecting these devices together so as to allow the circulating air to continuously flow through these devices.

BRIEF DESCRIPTION OF THE DRAWINGS

FIGS. 1 through 3 show an apparatus for adjusting the trace water content as the foundation of the apparatus in accordance with the present invention, wherein:

FIG. 1 is a block diagram of the apparatus as a whole;

FIG. 2 is a sectional side view of a device for effecting cooling, dehumidification as well as heating;

FIG. 3 is a side view showing an example of a koji producing chamber;

Initially, the outline of the apparatus of the present invention will be described with reference to FIGS. 1 through 3.

Figure 1:
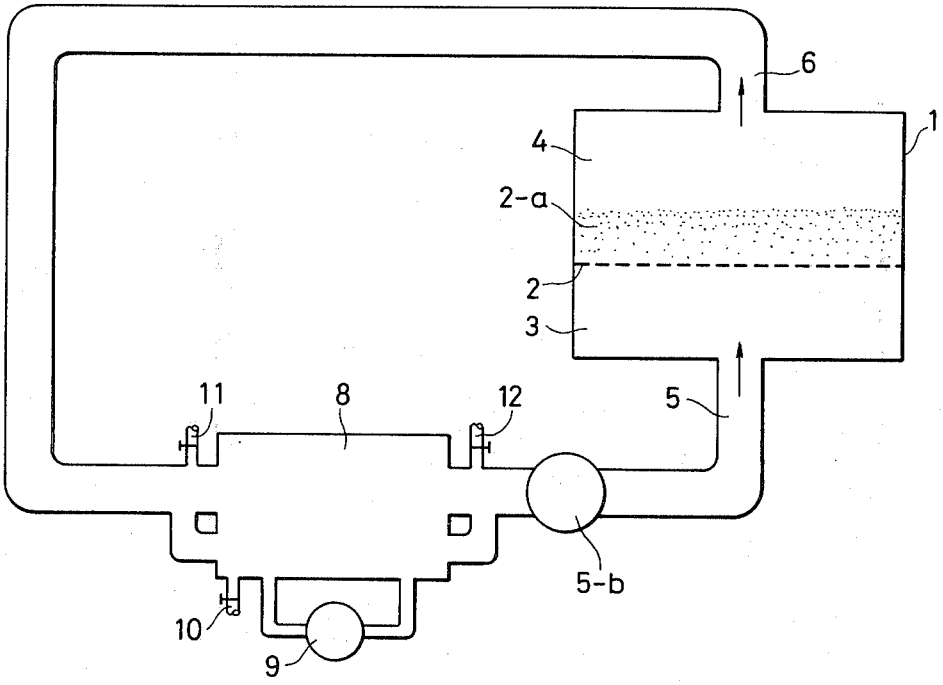

In FIG. 1, reference numeral 1 represents a water content adjusting chamber which also serves as a koji producing chamber. Inside the water content adjusting chamber 1 is disposed a net plate 2 which permits air to pass through a rice particle layer 2*a*. Reference numeral 3 represents an air introduction portion to which an air duct 5 is connected and to which the air is conveyed from a blower 5*b*. An air discharge port and an air intake port for fresh air may suitably be disposed in the air introduction portion 3.

Reference numeral 4 represents an air exhaust portion to which an air exhaust pipe 6 is connected to discharge the exhaust. Reference numeral 8 represents an apparatus (the detail of which will be described elsewhere) for performing cooling, dehumidification and heating by means of a heat pump device using a freezing cycle with one set of compressor, and the resulting water droplets are removed by a drain pipe 10. Reference numeral 11 represents a partial air exhaust which is employed in order to discharge a part of the air when the carbonic acid gas concentration becomes high during koji production. Fresh air may also be introduced from a feed pipe 12, thereby adjusting the carbonic acid gas concentration to a level suited for koji production.

Figure 2:
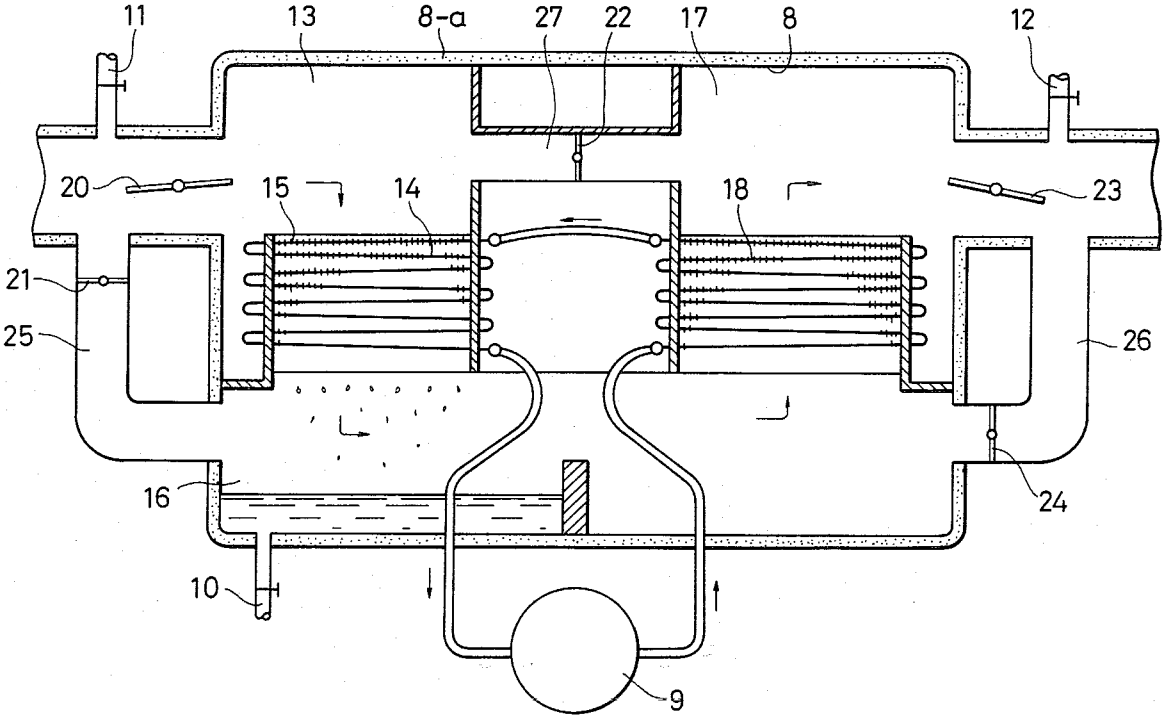

In FIG. 2, reference numeral 8 represents a cooler-dehumidifier-heater whose entire portions are covered with an adiabatic material 8*a*. Reference numeral 13 represents a dehumidifying chamber in which an evaporator 14 forming the freezing cycle is disposed. A cooling medium which is compressed by the compressor 9 and passes through a condensor 18 evaporates in this chamber, cools fins 15 and concentrates the water content in the circulating air into water droplets. The water droplets are stored in a water tank 16 and are discharged from time to time from the drain pipe 10. Reference numeral 17 represents a heating chamber in which the condensor 18 of the heat pump using the freezing cycle is disposed and which effects heating by utilizing the heat of condensation of the gaseous cooling medium that is compressed and heated by the compressor 9 of the freezing cycle. Accordingly, the circulating air is heated to the temperature corresponding to the temperature drop due to cooling by the compressor and is returned to its original temperature.

Reference numerals 20 through 24 represent valves, respectively, and reference numerals 25 through 27 represent by-passes. Each valve suitably operates and is capable of opening and closing the corresponding pipe. The by-passes 25, 26, 27 are used in abnormal cases such as when dehumidification of the air therein is not necessary, or when heating is not necessary or neither dehumidification nor heating is necessary.

Figure 3:
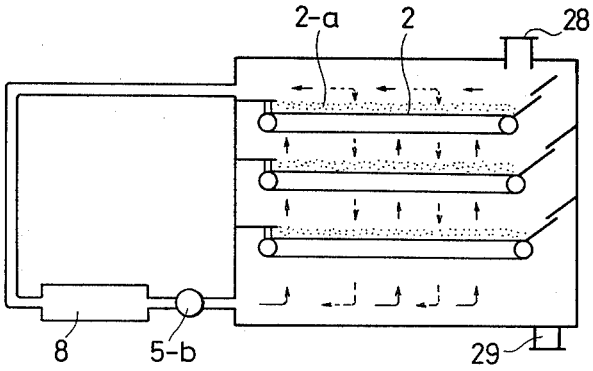

FIG. 3 illustrates a koji producing chamber. As depicted, thin layers are formed in three stages by the net plates 2 and the starting material 2*a* for the koji is fed into each stage from an inlet 28. Reference numeral 29 represents an outlet for withdrawing the koji.

In the apparatus described above, the cooling device (evaporator) and the heating device (condensor) by means of the heater pump using the freezing cycle is concurrently disposed at the intermediate portion of the air circulating route of the water content adjusting chamber of the koji producing chamber, and the air is allowed to flow through these devices in order to carry out fine adjustment of the water content of the rice koji and the steamed rice. Although this is an extremely revolutionary apparatus, it is not free from the following disadvantage.

Namely, since the abovementioned apparatus concurrently disposes the evaporator and the condensor of the heat pump using the freezing cycle and permits the air circulating through the koji producing chamber to sequentially flow through the evaporator and the condensor, the temperature of the circulating air gradually rises as it is affected by the exothermy with mechanical loss of the heat pump. Moreover, since the calorific value of the steamed rice or the heat of fermentation during koji production is not discharged to the outside, the temperature of the circulating air increases with the passage of the operation time of the apparatus due to this heat when the operation of the apparatus is continued, until at last it reaches a temperature which is not suited for koji production.

The present invention is directed to eliminates the abovementioned problem with the apparatus shown in FIGS. 1 through 3. Namely, in an apparatus for adjusting the trace water content in which net shelves are disposed in a koji producing chamber so that the koji, steamed rice, steeped rice or the like is placed on them, the air is allowed to flow through them from below to the above inside the koji production chamber while the air inside the chamber is withdrawn from an air exhaust at the upper portion of the koji producing chamber and is fed to a cooling side of a heat pump using a freezing cycle thereby to dehydrate the excessive steam, the dehydrated air is fed to the heating side of the heat pump for heating the air, and this air is fed into the koji production chamber from an air feed port disposed at the lower portion of the koji production chamber; the present invention is characterized in that a heat exchanger for the abovementioned heat pump is divided and its part is disposed outside the route of the circulating air to decrease a heating capacity of the circulating air by the heat pump and thus to prevent the temperature rise of the circulating air.

Hereinafter, an embodiment of the present apparatus will be described by referring to FIGS. 4 and 5.

Figure 4:
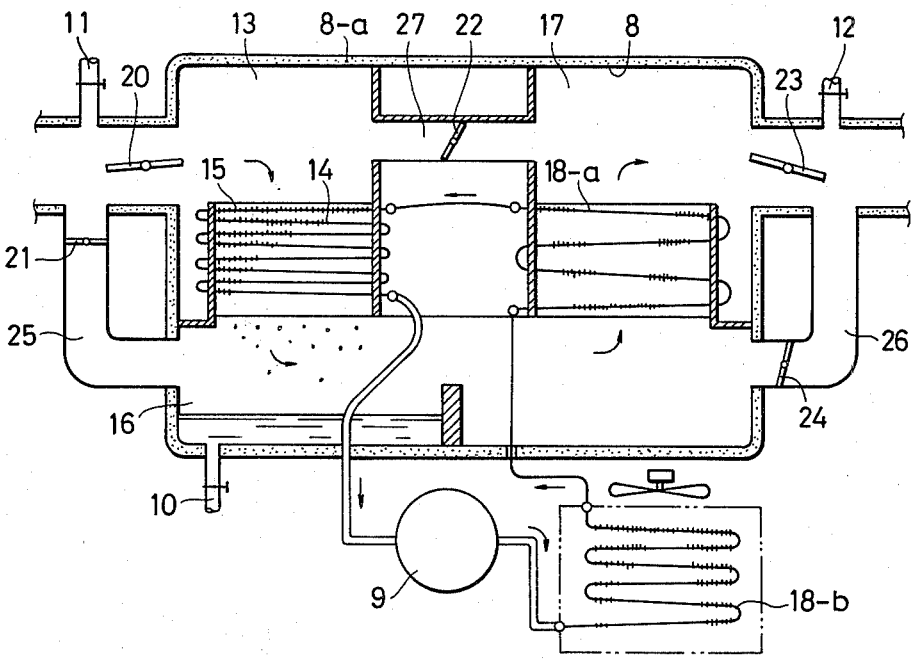
FIG. 4 shows an first embodiment of the present invention and is a sectional side view corresponding to FIG. 2.
Figure 5:
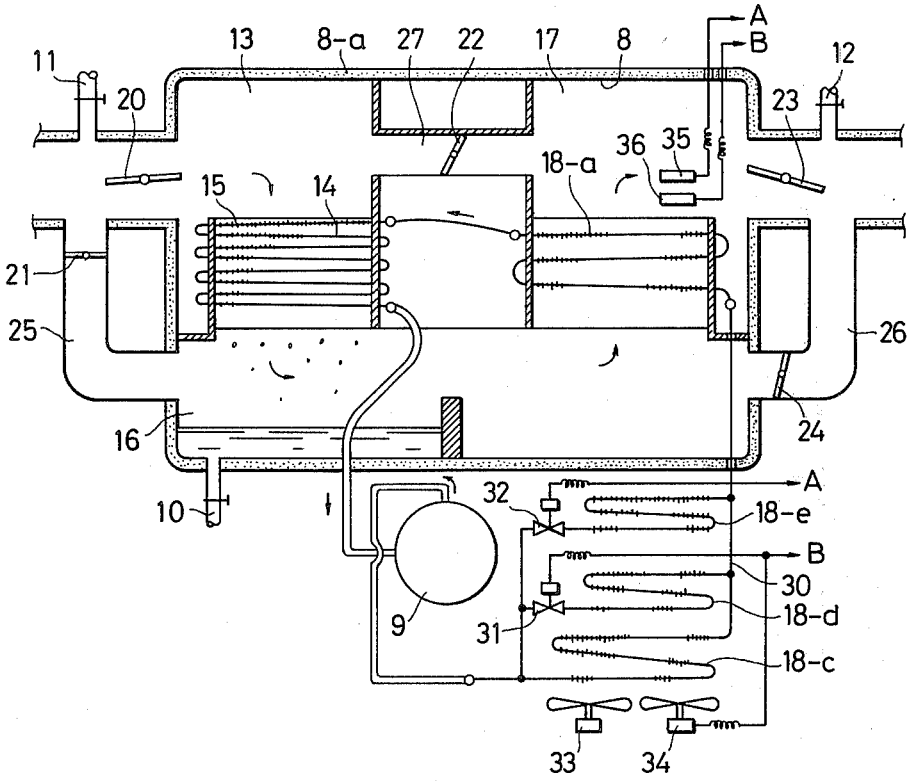
FIG. 5 shows a second embodiment of the present invention and is a sectional side view.

Incidentally, FIGS. 4 and 5 correspond to FIG. 2 of the aforementioned apparatus and the overall construction of the apparatus in the present invention is analogous to the one shown in FIG. 1 while the inside of the koji producing chamber is analogous to the one shown in FIG. 2. Accordingly, the overall construction of the apparatus and the detail of the inside of the koji producing chamber will not be explained.

In the embodiment shown in FIG. 4, the condensor forming the freezing cycle is divided into two heat exchangers 18*a* and 18*b* that are connected in series. Though the former 18*a* is disposed inside the route of the circulating cir, the latter 18*b* is disposed outside the casing of the cooler-heater 8, that is to say, outside the route of the circulating air.

In this apparatus, therefore, heating of the circulating air by the heat pump is effected only by the heat exchanger 18*a* as a part of its condensor and consequently, heating of the circulating air drops in comparison with the apparatus shown in FIG. 2. Needless to say, the ratio of the heat exchangers 18*a* and 18*b* forming the condensor is a matter of design that is to be experimentally determined in accordance with the operating conditions of the apparatus.

Accordingly, the apparatus of this embodiment makes it possible to eliminate the abovementioned drawback of the conventional apparatus of this kind in that the temperature of the circulating air rises with the operating time of the apparatus. If the ratio of the two heat exchangers is set to a suitable levle, variance in the temperature of the circulating air can be made slight. Thus, the apparatus of this embodiment makes it possible to drastically improve the practical utility of the apparatus for adjusting trace water content of the koji and the steamed rice.

FIG. 5 shows an embodiment as an improvement over the aforementioned embodiment (shown in FIG. 4). In accordance with this embodiment, further adjustment of the heating capacity of the circulating air can be made. Namely, in FIG. 5, the heat exchanger to be disposed outside the route of the circulating air is divided into three segments 18*c*, 18*d*, 18*e*, each being connected in parallel to the others.

More specifically, the discharge sides of the three heat exchangers are communicated with the intake side of a heat exchanger 18*a* disposed inside the route of the circulating air, via a common cooling medium pipe 30. The intake side of the heat exchanger 18*c* is directly connected to the discharge side of the compressor 9 but those of the other heat exchangers 18*d*, 18*e* are connected to the discharge side of the compressor 9 via electromagnetic valves 31, 32, respectively.

Reference numeral 33 represents a condensor fan which is normally operated and principally cools the heat exchanger 18*c*. Another condensor fan 34 is disposed, the fan 34 being operated only during operation of the heat exchangers 18*d*, 18*e* and primarily cooling them.

Two temperature sensors 35, 36 are disposed inside the heating chamber 17. The sensor 36 operates when the temperature of the heating chamber 17 exceeds a predetermined value and the electromagnetic valve 31 disposed on the intake side of the heat exchanger 18*d* is opened by the signal of this sensor and the heat exchanger 18*d* becomes operative. (In this instance, the fan 34 is also operative.) As a result, among the heat of condensation of the heat pump, the capacity alloted to the heating of the circulating air further drops and hence, the temperature in the heating chamber 17 drops.

When the temperature of the heating chamber further elevates due to influences of a load or the external temperature, the other sensor 35 becomes operative and the electromagnetic valve 32 disposed on the intake side of the heat exchanger 18*e* is opened by the signal of the sensor. Furthermore, the heat exchanger 18*e* becomes operative. As a result, out of the total heat of condensation of the heat pump, the heat capacity made use of for heating the circulating air further decreases and the temperature drops inside the heating chamber 17.

As described above, in the apparatus of this embodiment, the heat capacity used for heating the circulating air out of the total heat of condensation of the heat pump is step-wise adjusted. Accordingly, it is possible to maintain the heating temperature at a substantially constant level even in a place where variance of the external temperature is great or when a drastic change occurs in the heat capacity of the starting materials fed into the water content adjusting chamber. Thus, this embodiment is capable of further improving the practical utility of the apparatus for adjusting the trace water content of this kind.

As described in the foregoing, in an apparatus for adjusting the trace water content by allowing the circulating air that flows through a water content adjusting chamber, to sequentially flow through an evaporator and a condensor of a heat pump using the freezing cycle in order named and cooling, dehydrating and heating the air in order to adjust the trace water content of the steamed rice or the like in the water content adjusting chamber, the heat exchanger (condensor) for heating the circulating air is divided in the present invention and a part is disposed outside the route of the circulating air. This arrangement makes it possible to prevent the circulating air from being heated to an unnecessarily high level. Furthermore, the heat exchanger to be disposed outside the route of the circulating air is formed by a plurality of small heat exchanger groups connected in parallel to one another and any one of these heat exchangers is selectively operated by the temperature of the circulating air. According to this arrangement, the temperature change in the circulating air can be further decreased. Thus, the practical effect of the present invention is extremely remarkable.

What is claimed is:

1. An apparatus for adjusting the trace content of a rice-koji, wheat-koji, wheat bran-koji, steamed rice, steeped rice and the like, comprising:

a water content adjusting, koji-producing chamber having net plates disposed therein, an air exhaust portion at the upper portion thereof and an air introduction portion at the lower end thereof;

an air circulating route connecting said air exhaust portion and said air introduction portion; and a heat pump comprising a compressor, a condensor, and an evaporator, arranged in series and disposed at an intermediate portion of said air circulating route whereby the freezing cycle of said heat pump causes said evaporator to have a cooling and thus dehydrating function and said condensor to have a heating function;

wherein a first portion of said condensor is disposed in the airstream of said air circulating route and a second portion of said condensor is disposed outside the airstream of said air circulating route and wherein said evaporator is disposed in the airstream of said air circulating route upstream of said first portion of said condensor, both of said portions of said condensor being connected in series with said evaporator and said compressor.

2. An apparatus in accordance with claim 1, wherein said second portion of said condensor consists of a plurality of heat exchangers connected in parallel to one another, said heat pump further including temperature regulating means for determining the number of said heat exchangers to be rendered operative as a function of the temperature of said airstream in said air circulating route, more of said heat exchangers being rendered operative as the temperature of said airstream exceeds predetermined values.

3. An method for adjusting the trace content of a rice-koji, wheat-koji, wheat bran-koji, steamed rice, steeped rice and the like, utilizing an apparatus in accordance with claim 2, comprising:

placing the rice, wheat or wheat-bran particles on said net plates;

causing air to circulate through said water content adjusting chamber, air circulating route and heat pump; and regulating the temperature of the circulating air by means of said temperature regulating means.

4. An apparatus for adjusting the trace content of a rice-koji, wheat-koji, wheat bran-koji, steamed rice, steeped rice and the like, utilizing an apparatus in accordance with claim 1, comprising:

placing the rice, wheat or wheat-bran particles on said net plates; and causing air to circulate through said water content adjusting chamber, air circulating route and heat pump.

* * * * *